US005273122A

United States Patent [19]

Henneuse

[11] Patent Number: 5,273,122

[45] Date of Patent: Dec. 28, 1993

[54] AUTOMATIC METHOD FOR MONITORING THE VIBRATIONAL STATE OF A DRILL STRING

[75] Inventor: Henry Henneuse, Billere, France

[73] Assignee: Elf Aquitaine Production, France

[21] Appl. No.: 937,842

[22] PCT Filed: Feb. 25, 1992

[86] PCT No.: PCT/FR92/00169

§ 371 Date: Nov. 20, 1992

§ 102(e) Date: Nov. 20, 1992

[87] PCT Pub. No.: WO92/14908

PCT Pub. Date: Sep. 3, 1992

[30] Foreign Application Priority Data

Feb. 25, 1991 [FR] France ..... 91 02201

[51] Int. Cl.[5] ..... E21B 47/00

[52] U.S. Cl. ..... 175/26

[58] Field of Search ..... 175/24, 26, 40

[56] References Cited

U.S. PATENT DOCUMENTS

| | | | |
|---|---|---|---|
| 3,703,096 | 11/1972 | Vitter, Jr. et al. | 73/151 |
| 4,150,568 | 4/1979 | Berger et al. | 73/151 |
| 4,637,479 | 1/1987 | Leising | 175/26 |
| 4,903,245 | 2/1990 | Close et al. | 367/81 |
| 4,928,521 | 5/1990 | Jardine | 73/151 |
| 5,186,579 | 2/1993 | Hanamoto et al. | 175/26 X |

FOREIGN PATENT DOCUMENTS

| | | |
|---|---|---|
| 0409304A1 | 1/1991 | European Pat. Off. . |
| WO90/12195 | 10/1990 | PCT Int'l Appl. . |

*Primary Examiner*—Thuy M. Bui

*Attorney, Agent, or Firm*—Bacon & Thomas

[57] ABSTRACT

A method for automatically monitoring the vibrational condition of a drill string fitted with detectors comprises the following steps: obtaining a reference spectrum for each detector; obtaining a spectrum for each detector representing the actual situation; comparing the two spectra to detect possible instabilities in the values measured by the detectors; indication of said instabilities by means of audio and/or visual devices.

6 Claims, 5 Drawing Sheets

AUTOMATIC METHOD FOR MONITORING THE VIBRATIONAL STATE OF A DRILL STRING

The present invention relates to an automatic method for monitoring the vibrational state of a drill string.

Research in the oil industry has led to providing drill strings at their top with numerous sensors such as accelerometers and/or strain gauges, making available magnitudes such as torsional, axial or transverse accelerations, axial force, torque and bending moments.

However, the vibrational data coming from these sensors possess an obvious complexity for a non-specialist desiring to make use of them. Traditional spectrum analysers actually in general produce only curves whose analysis is not immediate.

However, the foreman driller needs to know instantaneously the vibrational behaviour of his drill string, and in particular a possible instability of the said behaviour, in order to be able to adjust as fast and as well as possible the various drilling parameters, namely the weight on the bit, the speed of rotation and also the mud flow rate.

These instabilities occur because the drill string consists of a mechanical assembly which has natural modes and which is capable of responding to various mechanical stresses occurring during drilling, such as working of the bit on the rock and interactions between the well and the said drill string, this being the case both axially and laterally or torsionally.

Such instabilities are to be eliminated because they are the origin of extra strain for the material which risks leading to breaking of the drill string; furthermore, they consume a portion of the energy which it would be preferable to transmit directly to the bit, the latter then being converted into energy for cutting the rock, which contributes to a more efficient advance of the drilling.

The object of the present invention is therefore an automatic method for monitoring the vibrational state of a drill string, which makes it possible to use the measurements provided by a set of sensors situated at the top of a drill string, in particular by warning a user in a simple manner of possible instabilities in these measurements.

In order to do this, the invention provides an automatic method of monitoring the vibrational state of a drill string provided with sensors, the said method comprising the following steps:

- obtaining a reference spectrum for each of the sensors,
- obtaining a spectrum for each of the sensors in real conditions,
- comparing the two spectra in order to detect possible instabilities in the magnitudes measured by the sensors,
- signalling the said instabilities by means of audio and/or visual devices.

Other characteristics and advantages of the present invention will emerge more clearly on reading the following description which is made with reference to the attached drawings in which.

Figure 1:
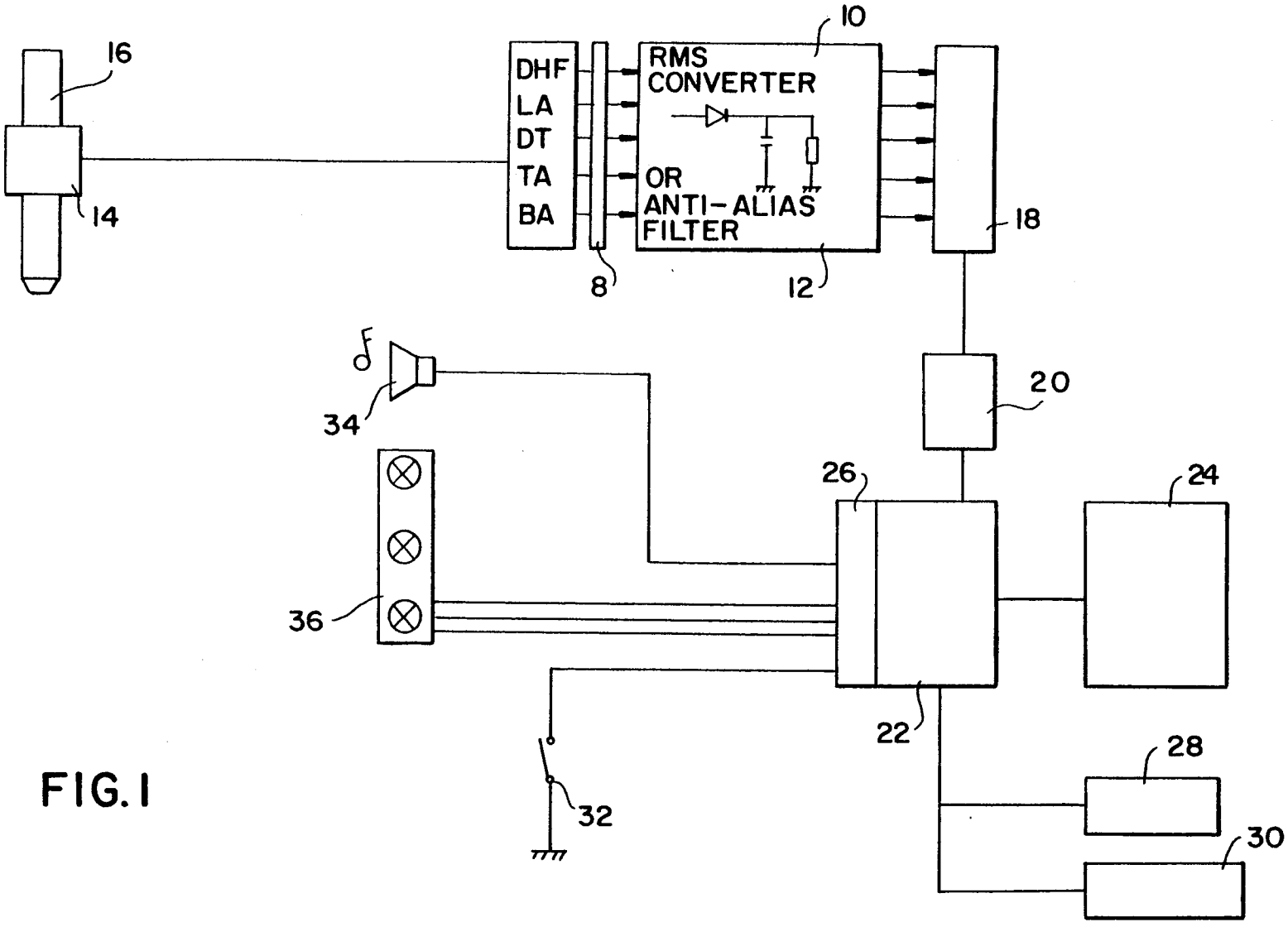
FIG. 1 is a block diagram of the whole of the monitoring system.

As represented in FIG. 1, the monitoring system comprises a bank of programmable filters 8 as well as RMS converters 10 or anti-aliasing filters 12 making it possible to process the signals coming from the sensors 14 disposed on the drill string 16; the data coming from the converters 10 are grouped at a multiplexer 18 then transmitted to an analog/digital converter 20 and finally to one or more processors 22. The microprocessor or microprocessors 22 are possibly assisted by one or more signal processors 24 and are coupled with an interface 26; the user may transmit data to the processor or processors 22 by means of a keyboard 28 and a communication link 30. It is possible to input to the interface 26 certain information concerning the reference spectra 32 relating to each sensor, the said interface 26 being connected to audio 34 and/or visual 36 signalling means.

In order to detect possible instabilities in the magnitudes measured by the sensors, it is suitable to carry out the following steps:

Obtaining a reference spectrum for each of the sensors:

In order to do this, two methods are possible. The foreman driller determines in the first case a state which he judges adequate for effective drilling, possibly assisted in this by a specialist in vibrations in the field of drilling. Various vibrational measurements provided by the sensors correspond to this state, these measurements being processed in the manner described below so as to obtain reference spectra relating to each of the sensors. The processing of the vibrational measurements may be made either coarsely, that is to say that they are sampled at a low frequency, for example 0.1 Hz, and only their RMS value is kept, or more finely, namely in that they are sampled at a frequency higher than 400 Hz after careful anti-aliasing filtering.

In the second case, simulation software, to which mechanical specifications on the drill string are supplied, produces the spectra relating to each of the sensors, it being possible for the simulation software, as desired, to be integrated into the system itself. The information thus produced is introduced to the processor or processors by means of a communication interface, the said processor only subsequently operating by comparison with these reference elements.

Obtaining a spectrum in real conditions:

For this purpose, the vibrational measurements provided by the sensors are processed in the same manner as for obtaining the reference spectrum, the said manner being described above; in the example illustrated, the magnitudes measured by the sensors are respectively the dynamic component of the force on the hook (DHF), the longitudinal acceleration (LA), the dynamic component of the torque (DT), the torsional acceleration (TA) and the bending acceleration (BA). The information is then transmitted to the processor after analog/digital conversion of the measurements.

Comparing the data and signalling possible instabilities:

This comparison may be done either between RMS values only, or between the complete spectra.

As regards the RMS values, the processor compares the said value with the predetermined reference value, this comparison being made in the form of the ratio of the two values, which allows calibration of the sensors, which is always tricky, to be dispensed with.

Figure 2:
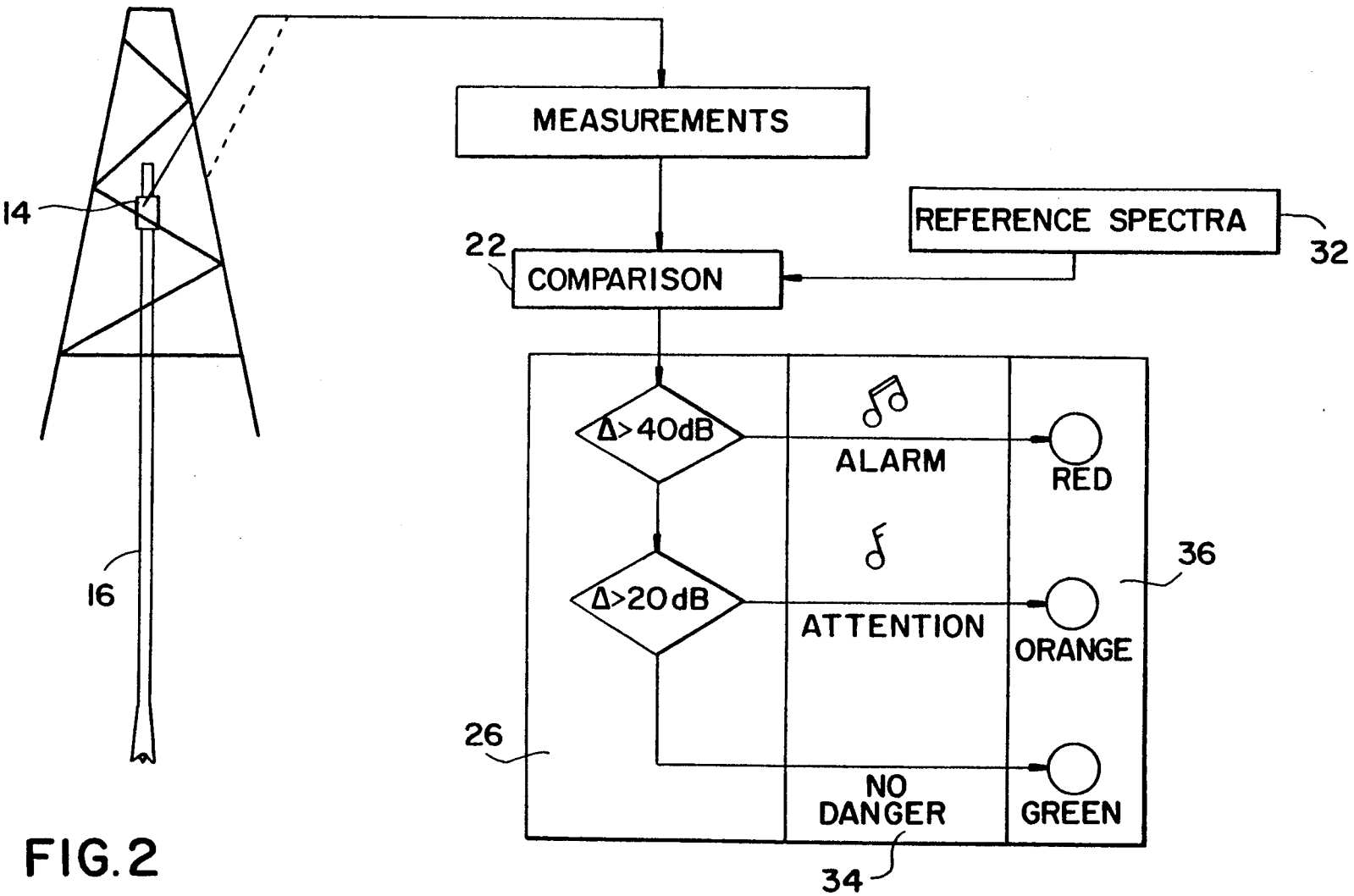
FIG. 2 is a logic diagram describing certain steps of the signalling to the user.

As represented in FIG. 2, if no RMS value exceeds 10 times its reference value, the situation is considered stable, and no warning is sent to the foreman driller.

If the level of at least one of them is between 10 and 100 times its reference value, the foreman driller is alerted and may, if he judges it to be necessary, vary the drilling parameters.

If the level of at least one of them exceeds 100 times its reference value, the foreman driller is alerted to the existence of a highly unstable situation which must be corrected as quickly as possible.

Processing involving the spectra is of the same type. The spectra obtained from each measurement by the processor are actually compared line by line with the reference spectra. In the same way as for the RMS values, the criteria corresponding to ratios of respectively 10 and 100 times greater than the reference values are used in the example illustrated. However, the values of 10 and 100 are arbitrary and may be modified, in both cases.

As represented in FIG. 2, the present invention makes it possible, in a simple manner, to signal to the foreman driller the level of instability of the various magnitudes measured by the sensors. In the example illustrated, a set of display lights is used, which is similar to conventional traffic lights used to regulate road traffic, as well as various audio signals.

In the example illustrated, a green display light indicates to the foreman driller the existence of a stable situation, an orange display light complemented by a disengageable discontinuous audible signal warns him of relative instability and a red display light complemented by a continuous audible signal alerts him to high instability.

Figure 3A:
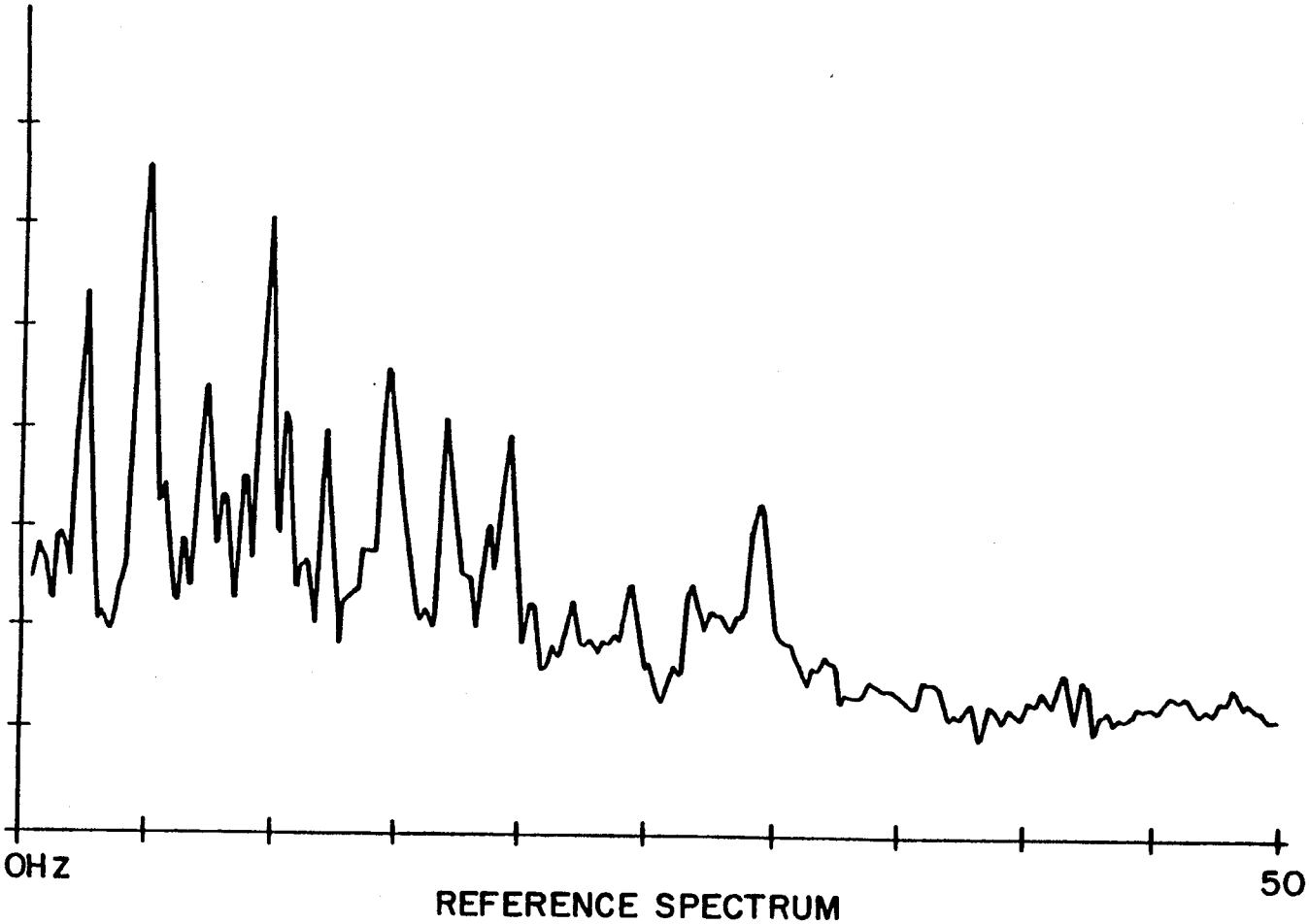
FIGS. 3*a*, 3*b* and 3*c* are explanatory curves of the present invention.
Figure 3B:
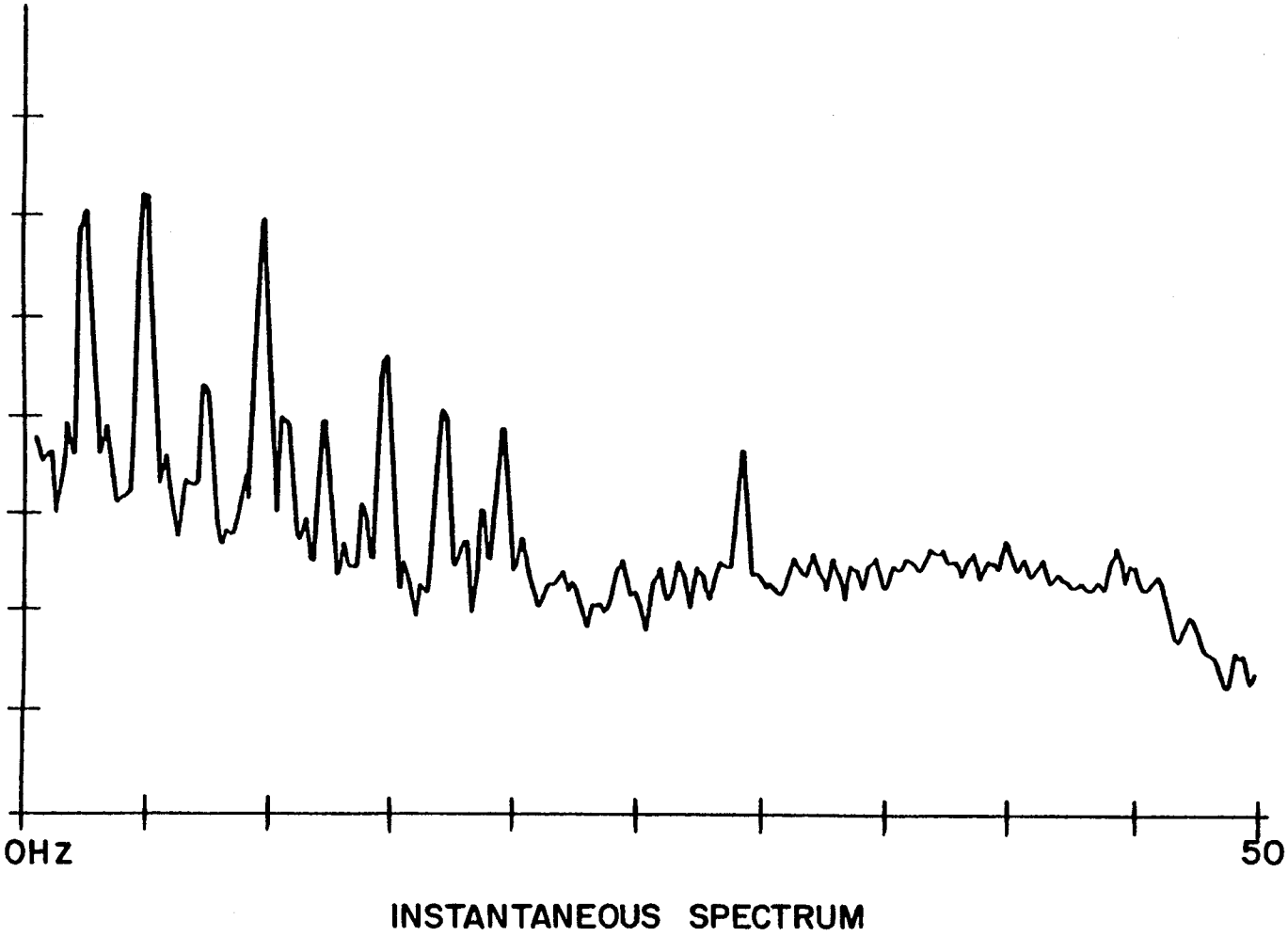
Figure 3C:
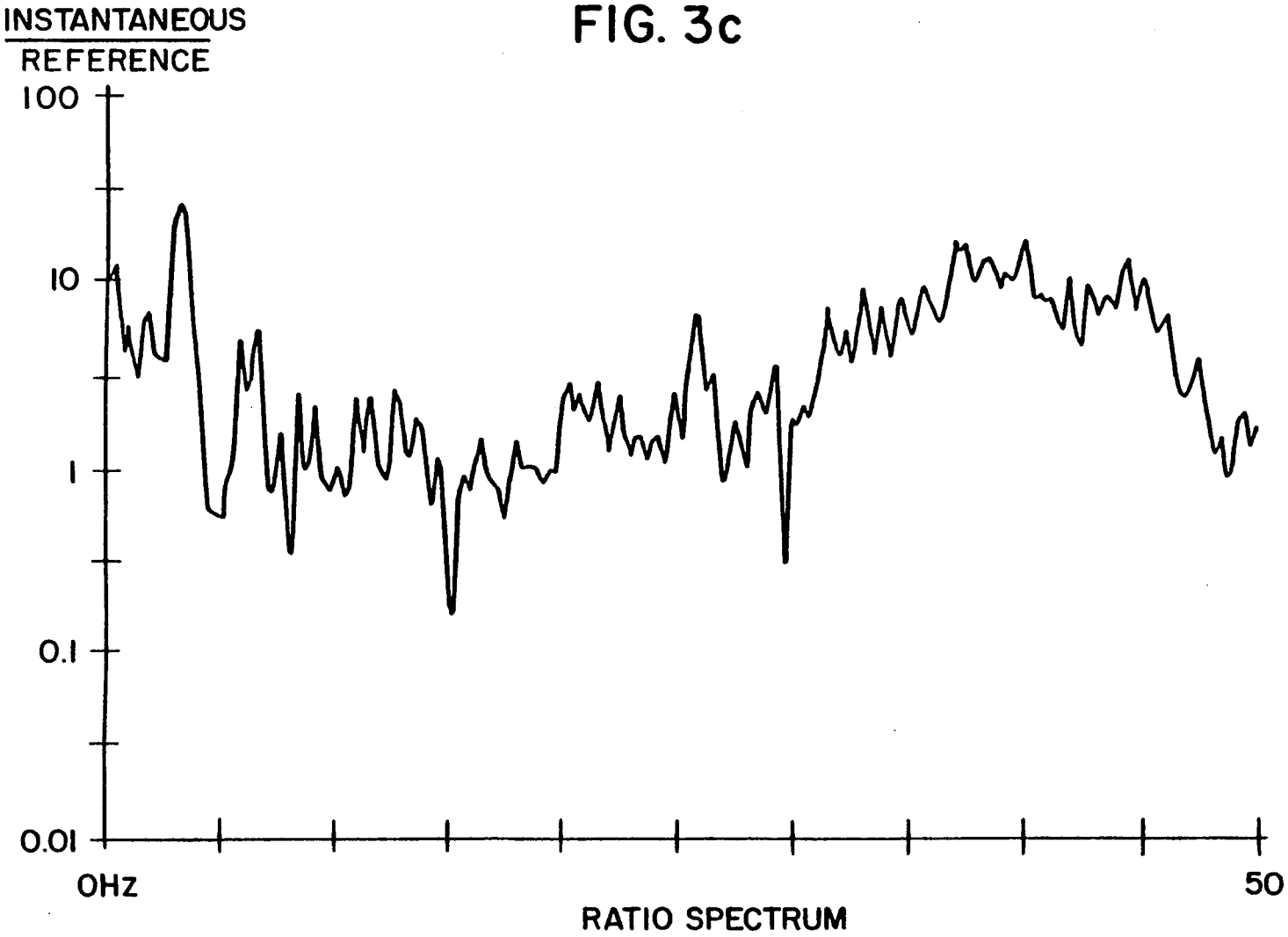

FIGS. 3*a*, 3*b* and 3*c* are explanatory curves of the present invention. Curves 3*a* and 3*b* are spectra obtained for the same sensor, the one 3*a* being a reference spectrum and the other 3*b* being an instantaneous spectrum corresponding to a real situation, the said spectra extending over a frequency range from 0.5 to 50 Hz. Curve 3*c* represents the ratio of the instantaneous spectrum to the real spectrum over the aforementioned frequency domain. From various values of this ratio, the apparatus is able to signal the user as to whether it is necessary to carry out, as desired, a modification of the various drilling parameters.

It should be noted that this monitoring system may be complemented by numerous algorithms, which allows substantial widening of its possibilities. Thus, it is possible to detect a possible disappearance of vibrations, corresponding respectively to ratios of 1/10 between the real spectrum and the reference spectrum for relative disappearance and of 1/100 for significant disappearance. The disappearance of the vibrations is of as much concern as the increase of the amplitudes, because it signifies amongst other things collapse of the well above the bit.

Furthermore the system which is the subject of the present invention makes it possible to process the data emitted from the bottom by an adapted tool and transmitted to the surface by any measurement method during drilling.

Thus, from the various audio and/or visual signals which reach him, the foreman driller may, as desired, make modifications which seem to him necessary to the various drilling parameters, such as the weight on the bit, the speed of rotation and the mud flow rate.

I claim:

1. Automatic method for monitoring the vibrational state of a drill string provided with sensors, the said method comprising the following steps:

obtaining a reference spectrum for each of the sensors, obtaining a spectrum for each of the sensors in real conditions, comparing the two spectra in order to detect possible instabilities in the magnitudes measured by the sensors, signalling the said instabilities by means for audio and/or visual devices, characterised in that the processing of the spectra is carried out over a range of frequencies extending at least from 0.1 Hz to 400 Hz, and in that, if the ratio between the real spectrum and the reference spectrum is between the safety value and the alarm value, this state is signalled to the user in order to allow him to modify as required the drilling parameters.

2. Method according to claim 1, wherein the signals provided by the sensors pass in succession through programmable filters, RMS converters or anti-aliasing filters, a multiplexer, an analog/digital converter and one more processors.

3. Method according to claim 1, wherein the comparison is made in the form of a ratio between the real spectrum and the reference spectrum.

4. Method according to claim 1, wherein the comparison is made either between RMS values alone, or between the complete spectra.

5. Method according to claim 1, wherein, if the ratio between the real spectrum and the reference spectrum does not exceed a safety value, the user is signalled that the drilling parameters may be kept.

6. Method according to claim 1, wherein, if the ratio between the real spectrum and the reference spectrum exceeds an alarm value, this state is signalled to the user so hat he can take action to modify the drilling parameters.

* * * * *